United States Patent [19]

Braconnier et al.

[11] 4,188,429

[45] Feb. 12, 1980

[54] PILE TEXTILE ELEMENTS WITH FUSED WRAPPER AND BASE

[75] Inventors: Daniel Braconnier, Ecully; Rene Guillermin, Bron; Sylvio Sangalli, Caluire, all of France

[73] Assignee: Rhone-Poulenc-Textile, Lyons, France

[21] Appl. No.: 915,525

[22] Filed: Jun. 14, 1978

[30] Foreign Application Priority Data

Feb. 8, 1978 [FR] France ..... 78 03738

[51] Int. Cl.[2] ..... B32B 3/02

[52] U.S. Cl. ..... 428/85; 15/159 A; 156/72; 428/88; 428/90; 428/92

[58] Field of Search ..... 428/85, 88, 90, 92; 156/72; 15/159

[56] References Cited

U.S. PATENT DOCUMENTS

| | | | |
|---|---|---|---|
| 1,956,592 | 5/1934 | Rindskopf | 156/72 |
| 3,017,307 | 1/1962 | Halliburton | 156/72 |
| 3,604,043 | 9/1971 | Lewis | 15/159 |
| 3,633,974 | 1/1972 | Lewis | 15/159 |

FOREIGN PATENT DOCUMENTS

| | | | |
|---|---|---|---|
| 579015 | 7/1946 | United Kingdom | 156/72 |

*Primary Examiner*—Marion E. McCamish

[57] ABSTRACT

Pile textile elements are disclosed in which heat fusible textile filamentary materials are assembled in a bundle wrapped in a plastic envelope. The filaments are held together at one end only of the bundle by fusing the ends of the filaments and the plastic envelope while they are in contact, under pressure, with a heated flat surface. The fused end of the bundle forms a base to facilitate handling of the pile textile element, and also facilitating securing the element to a suitable backing, such as a textile backing, furniture, bedding, etc., in a conventional manner.

22 Claims, 18 Drawing Figures

PILE TEXTILE ELEMENTS WITH FUSED WRAPPER AND BASE

BACKGROUND OF THE INVENTION

1. Field of the Invention

This invention relates to pile textile elements, of the tufted pile type, the process for their manufacture, as well as articles produced therewith. More particularly, this invention relates to pile textile elements formed from a plurality of heat fusible textile filaments wrapped in a plastic envelope which are joined together at one end of the bundle by heat fusing the filaments and the envelope.

2. Description of the Prior Art

Pile textile articles are generally produced by weaving or knitting or by needle-punching or tufting techniques. Pile textile articles can be used for garments or furnishings and are manufactured on a large scale, which can produce a desired uniformity in appearance, particularly for such applications as floor coverings or wall coverings.

However, it is also highly desirable to provide decorative articles, such as described in U.S. patent application Ser. No. 864,535, incorporated herein by reference, having a pile finish which is not necessarily uniform in color or texture and which may be made according to the personal or individual tastes of the consumer. This is accomplished, in accordance with the present invention, by providing individual pile textile elements, which can be sold in the form of a kit containing many such elements which may be of several different colors, lengths, denier sizes, etc., to allow the consumer to produce wall or floor decorations or furniture coverings meeting the needs of the individual.

It has already been known to prepare individual pile textile elements for decorative purposes such as rugs or other types of floor or wall coverings, for instance, U.S. Pat. No. 1,956,594 to Rindskopf. Pile textile elements or tufts have also been used in the manufacture of carpets by the process described in U.S. Pat. No. 3,904,799 to Shorroc. Pile textile elements have also been disclosed for use in the production of floors, brushes and similar articles in U.S. Pat. No. 3,017,307 to Halliburton.

British Pat. No. 579,015 to British Celanese Limited describes a pile textile element which may be employed in carpeting or upholstery materials or made into cloths, discs or wheels for cleaning or polishing purposes. According to the teachings of this reference, a bundle of yarns, threads, filaments, fibers or the like, having a basis of thermoplastic material and arranged in substantially parallel relationship, is subjected to a cutting and fusing operation to detach an individual section from the length of the entire bundle, whereby the thermoplastic material on one face of the section is fused to form a backing holding together the cut yarns, threads, filaments, fibers or the like. The cutting and fusing operation is performed with a heated wire which both performs the cutting and fusing function. In order to further secure the bundle of thermoplastic filaments in parallel relationship, this patent teaches enclosing the bundle in paper or cloth wrappings.

The market for coverings corresponds to one of the needs of contemporary man, who seeks to improve the environment in which he lives by rendering it comfortable, by looking for good heat insulation and sound insulation, and by creating for himself an agreeable decor. However, because of the uniformity due to the manufacturing limitations mentioned above, it is not possible for contemporary man to compose for himself an environment in accordance with his wishes, which he can likewise modify, thus achieving a personal work which is in accordance with his tastes and the atmosphere which he desires, in the way that he can do, for example.

The present application is concerned with proposing a solution which allows the individual himself to produce his decor in accordance with his wishes.

SUMMARY OF THE INVENTION

According to the present invention, we provide a pile textile article made from a pile textile element comprising a plurality of heat fusible textile filamentary materials assembled in an enveloped bundle and means securing the filaments of the bundle and envelope to one another at one end only of the bundle, the other end being free.

The filamentary textile materials which compose the element according to the invention can be of natural or synthetic textiles, used separately or as a mixture. They can be of equal length or different lengths, crimped or flat, of the same cross-section or of differing cross-section, or the same gauge or of differing gauges, and coloured or non-coloured. For the production of the pile textile elements, it is possible to use filamentary textile materials such as continuous filaments, spun fibre yarns, slivers or narrow tapes, employed individually or as mixtures. In the following application the term yarn will be used for all the above representations of filamentary textile material. The yarns may or may not be coloured. These elements are generally of a solid, flat or cylindrical shape; it can be of interest, for the purpose of varying the effects and reducing the surface frizzing of the articles produced from the pile textile elements of solid shape, and furthermore for the purpose of facilitating the dyeing of the said elements, to provide pile textile elements which comprise at least one void.

The pile textile elements can be connected to a support or footpiece by the end which holds all the yarns secured to one another.

The present invention also relates to several processes of manufacture of the pile textile element mentioned above. A preferred process involves the steps of assembling the yarns in parallel to form a bundle, surrounding the bundle with an envelope and cutting the envelope at one of the ends which holds the yarns of the bundle in place.

The envelope can be flexible such as a plastic film or an adhesive paper; when crepe paper is used, it is held in place by a film of adhesive paper at the position of the seam or by rings or ties. It is also possible to hold the base of the textile element together by welding/cutting, the yarns being welded to one another during this operation. The envelope can be rigid, such as a plastic base which may be flat or may comprise a means of fixing the pile textile element. The envelope can be kept in place or be removed depending on its nature, on the article to be produced and on the wishes of the producer. The pile textile element can have a self-adhesive base.

According to another process, the pile textile element is produced by cutting a coil of yarn along at least one generatrix of the coil; the cut yarns are kept in place at the cut end by glue or by an adhesive surface or preferably, if the yarns lend themselves to this, by welding, using the welding/cutting/pinching process which makes it possible in a single operation both to produce the cut and to produce the cohesion of the strands by welding, thus automatically forming the pile of the pile textile element. The pile textile element can be provided with a detachable base, which ensures both the stability of the yarns and the stability of the assembly, this detachable base being either flexible such as a small planar surface of textile or film, or rigid.

If pile textile elements comprising at least one void are employed, the void can be central and/or peripheral or can form concentric circles.

For the manufacture of pile textile elements comprising voids, the procedure followed is as above, but with the introduction of a core during the manufacture of the elements, this core either being associated with the device and leaving its imprint, or forming part of the elements introduced into, and then shaped by, the device; the core will be removed subsequently, at the same time as the envelope, or at a different time. The core can be a flexible or rigid body.

An object of the present invention is shaggy textile elements consisting of a collection of parallel textile strands kept in an envelope for at least a portion of their length which are obtained by cutting and soldering the strands of a base of the elements by fusion, characterized in that the base has a flat shape and projects regularly from the envelope in a plane perpendicular to it over a small width and over the entire circumference of the said base, and that the envelope is made of plastic film.

Another object of the present invention is to provide a procedure for manufacturing the textile element claimed above, characterized in that, after the plastic envelope has been put in place around the strands, the end of the element is put in contact with a heated surface in a plane perpendicular to the latter and controlled pressure is applied, permitting the fusion of the ends of the strands and the plastic envelope in order to cause a small quantity of melted matter to project on the circumference of the base of the element and thus give the melted ends of the said strands a homogeneous cohesion, with the operation of cutting the nonmelted portion being carried out before, during or after the fusion of the other end.

It is a further object of this invention to provide a method of textile element manufacture with controlled pressure which permits continuous, flexible supplying or feeding performed in such a way as to compensate for material that melts and to allow for the quantity of material absorbed by the melted end of the element.

BRIEF DESCRIPTION OF THE DRAWINGS

In order that the invention will be better understood, the following description is given, merely by way of example, reference being made to the accompanying drawings, in which.

DETAILED DESCRIPTION OF THE INVENTION

Figure 1:
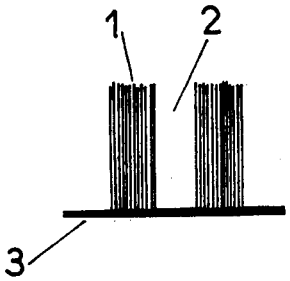
FIGS. 1 to 6 represent different embodiments of a pile textile element according to the invention.
Figure 2:
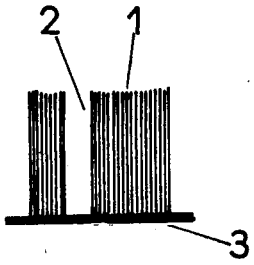
Figure 3:
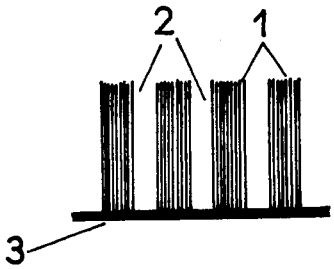

In FIG. 1, the pile textile element comprises a plurality of parallel yarns 1 assembled in a bundle having a central void 2, the yarns being secured to one another by a base 3. In FIG. 2, the void 2 is eccentric and in FIG. 3 there are two concentric voids 2, which may also be eccentric.

Figure 4A:
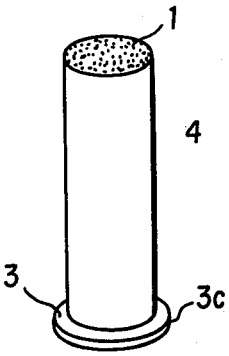
Figure 4:
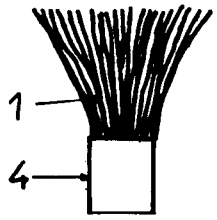

FIG. 4 shows an envelope 4 at the lower end of the element, the envelope holding the yarns 1 at that end, the yarns spreading out freely at the other end.

Figure 5A:
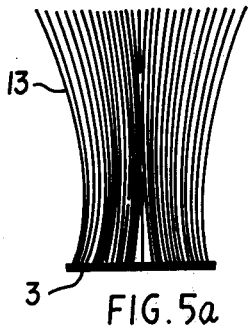
Figure 5:
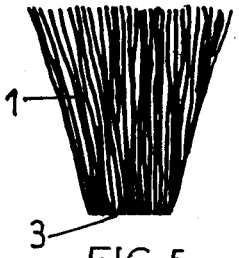

FIG. 5 represents a pile textile element without an envelope, the yarns being held together at the base 3 by welding or glueing.

Figure 6:
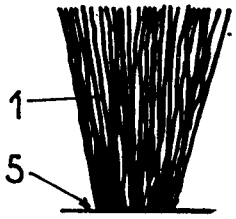

In FIG. 6, yarns are held together at the base 3 by welding or glueing with a detachable element 5.

Figure 7:
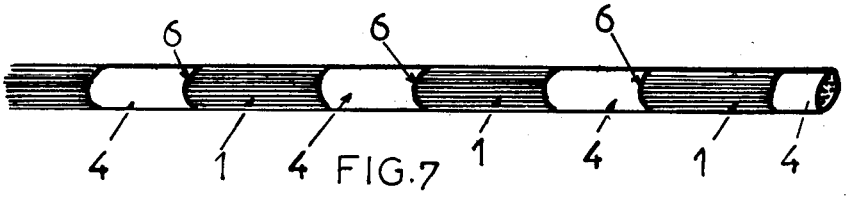
FIG. 7 represents one way of forming the pile textile element.

FIG. 7 shows yarns such as continuous filaments 1, held in certain places by rings or envelopes 4, a cut being made at the positions 6, so that the ends of the yarns formed by the cuts are held together by the envelope, while the other ends are free.

Figure 8:
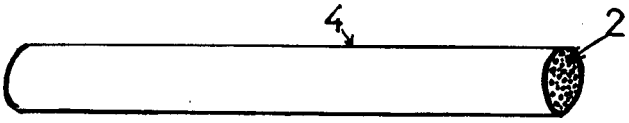

FIG. 8 shows yarns held by an envelope 4, this enveloped cylindrical form subsequently being cut to the desired length.

As indicated, the present application also relates to the pile articles produced by means of at least one pile textile element.

The pile textile element can be used in furnishing, bedding, coachwork, garments, toys and generally, for any decorative effect. As it can be of any shape and any colour, it makes it possible to produce fancy effects as desired.

It is possible to use self-adhesive elements which have a base coated with a glue covered with a release strip; this glue, based on elastomers, is used on a support which is itself coated with a solution, for example a flexible textile surface; this form of use makes it possible to produce very varied patterns on the actual place where it is desired to see them, whilst conventional decorative elements (carpets, tapestries, and the like) are generally produced outside (that is to say not on site).

It is also possible to introduce a dyeing operation into the process of manufacture of the elements.

This process of dyeing, in line with manufacture, can be carried out either before, during or after the making-up of the pile textile elements, whether the elements be solid or include voids. If the dyeing operation is carried out before, the yarns can, for example, pass through an impregnation vat and then be subjected to fixing, rinsing and drying, the yarns either being kept in a hank or being spread out and kept parallel by means of, for example, a comb; other means of dyeing can be used, for example by transfer, by printing, by vapour-deposition, by deposition of a dyestuff and use of a doctor blade, or by a brief continuous exhaustion process.

If the dyeing operation is carried out in the device for the manufacture of the pile textile element, the dyestuff can be deposited on accordance with the processes, and by means of the dyeing device, described in U.S. Pat. Nos. 3,644,809; 3,751,778 and 3,955,254 of the applicant company. It is thus possible, if the pile textile element being formed has a void produced by a part of the device, to introduce the dye through the said part of the device, this dyeing then taking place from the interior of the pile textile element being formed.

If the dyeing operation is carried out after production of the pile textile element, it is possible to use, for example, the process which forms the subject of the above-mentioned patents, or the brief continuous exhaustion process, or to use one of the means employed for dyeing before manufacture of the element.

It is also possible to obtain special effects by combining the dyeing before and/or during and/or after the manufacture of the pile textile element. It is also possible to arrange to use, as the envelope, a special carrier coated with a dyestuff which is transferable by heat treatment.

It is equally possible to envisage carrying out the dyeing of the yarns after the latter have been cut or placed in position, so as to produce decorative effects; for example, if "do-it-yourself" articles, sold in a box, are concerned, these can contain, in addition to the yarns, means of dyeing in the form of capsules, or injectable by means of a syringe; the user can thus produce the patterns which he desires.

It is also possible to carry out the dyeing of the pile textile elements in line with the manufacture of the yarn, if a continuous textile is concerned, thus, the manufacture of the yarn, its texturizing, if any, its dyeing and its continuous combination with other yarns to produce pile textile elements will be carried out continuously.

Figure 9:
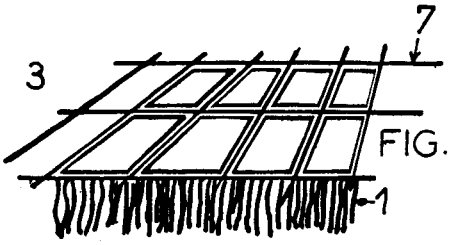
FIGS. 9 to 14 illustrate various possibilities of the use of pile textile elements according to the invention.

With the pile textile elements which form the subject of the present invention, it is possible to produce wall panels for decorative use, by mounting the pile textile elements on a support, which is a gauze with square meshes; as indicated in FIG. 9, the pile elements are arranged upside-down and the base 3 is arranged on top, embedded in a fusible plastic associated with the gauze 7, by application of heat by means of, for example, a hot soldering iron. The surface thus obtained can be designed in the form of strips which can be cut off or torn off.

Figure 10:
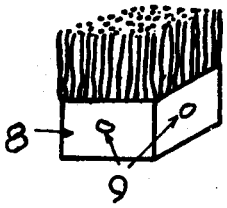

It is also possible to trap the base of the pile textile element in a means 8 formed with two channels 9 or openings which pass, at right angles, through the means 8 or base (FIG. 10). It is thus possible to thread together several pile textile elements like beads, so as to produce the desired decorative object; the textile elements can have differently shaped bases, different colours, different sizes and the like.

Figure 11:
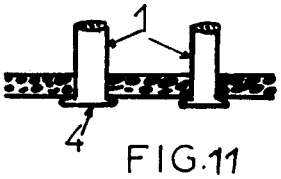
Figure 12:
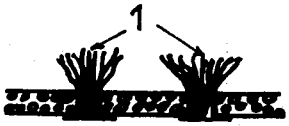

It is also possible to produce decorative effects by implanting pile textile elements, for example, in an armchair 10 made from a block of expanded plastic foam, in which orifices have optionally been produced for the insertion of the pile textile elements, this insertion taking place from either one side or the other of the sheet of expanded plastic, as illustrated respectively by FIGS. 11 and 12, the element being inserted (FIG. 11) through the reverse orifice; in that case, it is preferred to use the base element illustrated in FIG. 6, provided with an envelope which is thereafter withdrawn, so as to facilitate the spreading out of the pile (FIG. 12).

Figure 13:
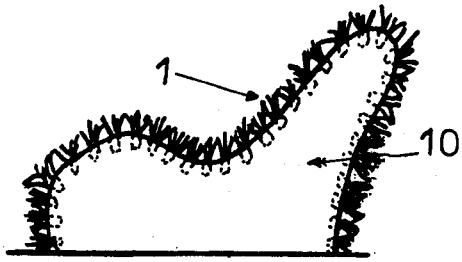
Figure 14:
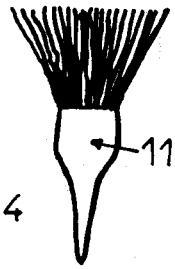

It is, of course, possible to implant the pile textile elements directly in the moulded block of foam 10, as illustrated by FIG. 13, either by producing orifices in which the elements are inserted or by implanting elements provided with a pointed base 11 provided for this purpose (FIG. 14).

Another example of the use of these pile textile elements is to fix them to the ceiling so as to give seaweed-type pile effects, the pile being in that case very long and of varying lengths; this fixing to the ceiling, as with the fixing for a decorative wall pattern, can be effected by any means, for example by magnetic means. To facilitate the connections, the bases of the pile textile elements are preferably of geometrical shape, but their surface is immaterial and depends on the desired effects. Delivered in this way, ready to use, or to be cut up at home, it is possible to achieve a personal work, using the pile textile elements. An additional advantage resides in the possibility of changing the designs when desired, or when they are worn.

The examples which follow illustrate the present invention without limiting it.

EXAMPLE 1

A bundle is formed from 50 yarns each consisting of a double yarn of twist 100 turns per meter in the Z-direction, of two yarns of 100 turns in the Z-direction, each of these two yarns being of 2,800 dtex/136 filaments and consisting of poly(hexamethylene adipamide).

With this bundle, pile textile elements such as shown in FIG. 1 are produced by the process illustrated in FIG. 4. The total length of the element is 5 centimeters and the length of the adhesive crepe paper envelope is 2 centimeters. The pile textile elements obtained are implanted in a car seat of expanded plastic foam on which the pattern which it is desired to reproduce has been printed. In order to implant the tufts, the foam is pricked with a needle in the previously marked areas, an opening-out tool is used to enlarge the orifice obtained and the elements, of which the base has beforehand been coated with a neoprene glue, are implanted.

A pile-covered seat is thus easily obtained.

EXAMPLE 2

A bundle of 80 yarns each consisting of a double yarn of twist 100 turns per meter in the Z-direction, of two yarns of 100 turns in the S-direction, each of these two yarns being of 2,800 dtex/136 filaments and consisting of poly(hexamethylene adipamide). This bundle is given a slight twist and is passed into a device in which it is enveloped by an adhesive crepe paper.

A long cylindrical mass of enveloped yarns, as shown in FIG. 8 is thus obtained, which is subsequently cut to the desired length, the envelope holding the strands compact over the entire length of the element until the latter is put into position. This is done after cutting, by coating one side of the element with a glue and positioning it on a textile surface; after drying, the envelope is pulled off. An advantage of this process is that 100% of the pile is at the surface because no implantation has been carried out.

A flexible decorative article is thus obtained.

EXAMPLE 3

40 ends of a twisted yarn obtained by twisting, at 80 turns per meter in the S-direction, two continuous yarns of poly(hexamethylene adipamide) of gauge 2,800 dtex/136 filaments, each yarn having a twist of 80 turns per meter in the Z-direction, are arranged about a core consisting of a 4 mm diameter rod of expanded polystyrene.

The pile textile element obtained, of 14 mm diameter, is surrounded by crepe paper held in place by an adhesive tape. The cigarette-type element obtained is cut into 50 mm lengths. The core of expanded polystyrene is subsequently destroyed, after glueing the pile textile elements onto a support, by treatment with a small amount of trichloroethylene vapour, which thus makes it possible to cause the said polystyrene to disappear, only leaving a few traces towards the base of the pile textile element, which is thus in the form of a hollow cylinder.

EXAMPLE 4

60 continuous yarns of poly(hexamethylene adipamide) of gauge 2,800 dtex/136 filaments are arranged parallel, to form a web, by means of a comb. This web-type presentation passes through an impregnating vat containing an aqueous solution of the following products:

Thickener: 3 to 4 g/liter of Solvitose GUM OFA, a nonionic product obtained from galactomannane (Messrs. DIAMOND SHAMROCK France, formerly DOITTEAU).

Dyestuff: 5 g/liter pf Nylozane Yellow E-GL (Messrs. SANDOZ-C.I. Acid Yellow 29/1).

Wetting agent: 4 g/liter of Hostapal CV, a nonionic product obtained by reacting an alkylphenol with ethylene oxide (Messrs. HOECHST).

Foaming agent: 3 g/liter of Doitteau 27C, which is a modified fatty alcohol-sulphate.

Acetic acid is added in sufficient amount to bring the pH of the bath to between 3 and 4. The bath temperature is ambient temperature. The yarns pass, as a web, through the vat and then through a padder; the dyeing is thereafter fixed by steaming at 100° C.; the yarns again pass into a vat for rinsing, drying being carried out subsequently at a temperature of 180° C.

The dry, coloured yarns are finally turned back into hanks and are converted to pile textile elements as described above, namely by applying a crepe paper envelope, holding the whole by means of an adhesive tape and then cutting it into 50 mm lengths.

EXAMPLE 5

A pile textile element of 12 mm diameter is produced from a bundle of 40 continuous yarns of poly(hexamethylene adipamide), of gauge 2,800 dtex/136 filaments, using a perforated envelope.

The envelope obtained then passes into an impregnation tank containing the same constituents as in Example 1, except for the dyestuff used, which in this case is Trichrome Yellow JRLL (Pechiney-Ugine-Kuhlmann - C.I. Acid Yellow 121). It is then subjected to the same fixing, rinsing and drying operations, after which it is cut into 40 mm long elements.

Figure 15:
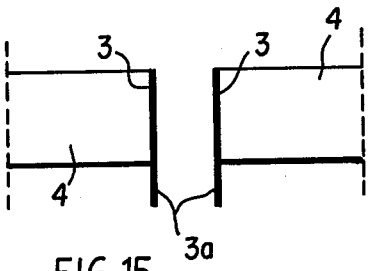
FIGS. 8, 15 and 16 show other ways of forming the pile textile elements.

When using a means of cutting (a blade or wire) heated to a high temperature, a train of melted matter results which thus produces a nonuniform base such as is shown in FIG. 15, in which one can distinguish the base 3, the envelope 4 and the nonuniform overflow 3*a*, in the direction of the cut indicated by the arrow, of the melted matter constituting the textile strands.

Figure 16:
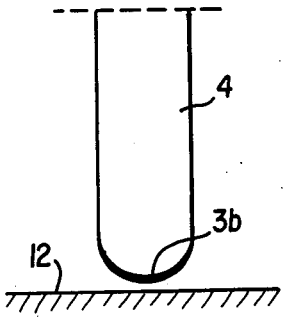

Furthermore, when using a procedure which consists of first cutting the base and then putting the base into simple contact, without pressure, with a heating surface, a soldering by fusion of the ends of the strands of the base is indeed obtained, but a contraction of the melted material and a continuance of the melting after contact as a consequence of heat radiation are also produced. This results in an increased soldering time, a tendency toward the formation of a central accumulation of melted material and insufficient cohesion of the strands on the edge of the textile element, and then it produces a nonuniform base, not projecting, such as is shown in FIG. 16, in which one can distinguish the melted base 3*b*, the envelope 4 and the heated surface 12. Furthermore, when applying slight pressure, an overflow or projection 3*a* may not be obtained and the textile strands close to the circumference are poorly held, which may be detrimental to the subsequent presentation of the articles made with these shaggy elements.

A preferred embodiment of this invention provides for the strands to be regularly secured in the base by the melting of their ends. This is accomplished by the application of regular pressure along the element's axis and perpendicularly to the heated surface permitting a small quantity of melted material resulting from the melting of the ends of the textile strands to project on the circumference of the base of the element. The small quantity is added to the fusion of the envelope and thus holds the strands solidly in the base, on its periphery.

In putting it into practice, one preferably uses elements consisting totally or partially of textiles made of thermoplastic material such as the textiles with a polyamide base (homopolymer or copolymer, or a mixture), for example. As regards the envelope, considering that it is around the textile element, it should melt rapidly. Preferably, one would use a film with a low melting point—for example, one with a polyolefin base.

Any manual or mechanical means which makes it possible to perform the cutting and melting of the selected end of the element by the application of pressure on the heated surface may be employed. It is possible to apply the pressure by means of the element or by means of the heated surface which is supported on the well-centered end of the element, perpendicular to its axis. The temperature to which the heated surface is brought, the pressure exerted and the period of time during which the said pressure is exerted depend upon the nature of the textile and the speed of cutting. The following ranges may be employed:

| | |
|---|---|
| Pressure | 10 to 600 g/cm$^2$ |
| Metal surface, preferably of stainless steel, brought to a temperature of | 500 to 900° C. |
| Duration of pressure | From 1/10th of a second to 5 seconds |

Preferably, but not necessarily, one will use the device which is the object of the French patent application No. 77/08618, which corresponds to U.S. patent application Ser. No. 878,462, which is incorporated herein by reference. As is described in that application, the continuous textile strands, which are kept parallel to each other, are moved, after being placed in the envelope, in such a way that the free end of the very long, continuous element formed comes into contact with a flat, heated surface which is perpendicular to it. The element is fed to the heated plate in order to communicate pressure to it being brought about by the winch and its accessory roller. As soon as the base is melted, and almost at the same time, the means of cutting, set at a specific height, cuts the element from the continuous strands. The element is then withdrawn, permitting the advance of a new length, which once again comes into contact with the heated surface, and so on.

The element formed in this way is as represented in FIG. 4*a*, in which one can distinguish the textile strands 1, the envelope 4, the base 3 and the regular projection 3c on its circumference, giving the object formed in this way the appearance of a cartridge case or an artillery shell. This flat base, with peripheral feeding, makes it possible to manipulate the element better, to tie the hairs or strands to the periphery of the said element better and to fix that element evenly on the appropriate support in accordance with the ultimate application that is desired. When elements such as those represented in FIG. 16 of the principal application are manufactured, the peripheral strands 13, after the envelope has been removed, tend to become detached from the base 3 when they open out, as can be seen in FIG. 5*a*. A flat, supplementary element 8, as shown in FIG. 10, avoids this disadvantage. On the other hand, when the envelope is fused with the base and the unfused portion of the envelope is removed by cutting or tearing along the border between the fused and unfused portions, all the strands open out and the peripheral strands 13 remain well fastened to the base 3 without any need for adding a supplementary element. Thus, a textile element which can be used at once and whose base, although it is melted, remains relatively flexible, and not brittle, is easily obtained. The base is ductile and can be perforated in order to introduce a stem, for example, if one wants to make a flower or a collar. The projection permits the base to remain in position without supplementary assistance in a perforated support, such as the mesh of a flexible, grill-type net made of plastic material, when one wants to make shaggy surfaces such as carpets or wall tapestries, as taught in U.S. patent application Ser. No. 864,535. In that case, the elements are easily interchangeable and provide more stability than those shown in FIG. 15 in which the projection of the base is not distributed regularly.

The following examples illustrate, but do not limit, the present embodiment:

EXAMPLE 6

One feeds a cluster of 50 threads, each consisting of a two-piece or two-end twist with a torsion of 100 turns in the Z-direction, and of two threads, each with a torsion of 100 turns in the S-direction, made of poly(hexamethylene adipamide), each of 2,800 dtex/136 strands, into a device such as the applicant's French patent application No. 77/08618 noted above. The envelope used is a film made of polyethylene 50 mm wide whose two edges are connected by soldering by means of a heated "nollette" or knurling wheel. The end of the element under the envelope, after it has passed around the winch, is brought into contact with a heated metallic surface of stainless steel at 600° C. for a period of 0.8 seconds, feeding ahead or overfeeding by 2 mm of the distance between the lower end of the pneumatic means and the said surface, with the element being kept under pressure during the fusion by that feeding and the pressure being exerted being 500 g/cm$^2$. The melted strands overflow or project beyond the base of the element regularly all around its circumference.

The element obtained has a length of 5 centimeters and a diameter of 14 millimeters, except for the base, which has a diameter of 16 millimeters.

EXAMPLE 7

With the same means as in Example 1, shaggy textile elements are made according to the demand, with the time of pressure being 0.5 seconds, the temperature of the stainless steel metallic surface being 700° C., and the pressure exerted 250 g/cm$^2$.

The elements obtained in this way, like those of Example 1, can easily be incorporated into a perforated base.

Manufacturing of the above structure results in a process for preparing a pile textile element for decorative pile articles wherein a bundle of a plurality of substantially parallel heat-fusible, filamentary textile materials, which may be encased over a portion thereof, or its entire length, with a wrapper and a heat-fusible filamentary textile material, are fused together by application of heat at one end of the bundle. In particular, the method of manufacturing includes encasing a bundle of a plurality of substantially parallel heat-fusible filamentary textile materials over at least a portion of its entire length including at least one end thereof with a wrapper. The covered end of the encased bundle is placed in contact with a heated surface at a temperature higher than the melting point of the heat-fusible filamentary textile materials, the surface being located in a plane which is perpendicular to a plane containing a longitudinal axis of the bundle. Pressure is applied between the heated surface and the end of the bundle in contact with the heated surface so that the heat-fusible filamentary textile materials are allowed to melt and uniformly flow over and slightly beyond the circumference of the wrapped bundle. The bundle is removed from the heated surface, thereby forming a flat base at one end of the bundle which projects uniformly beyond the circumference of the bundle.

When manufacturing a bundle in which the wrapper is heat fused with the base, the method of manufacture is altered in that the wrapper is also placed in contact with the heating surface and the pressure applied between the heating surface and the bundle also includes pressure to the wrapper. In such a situation, the materials and the wrapper are allowed to melt and uniformly flow over and slightly beyond the circumference of the wrapped bundle before being removed from the heated surface.

Various changes may be made in the details of the invention, as disclosed, without sacrificing the advantages thereof or departing from the scope of the appended claims.

Furthermore, although the present invention has been disclosed and discussed with particular regard to its acceptional advantages in terms of pile textile element structure and formation, it is understood that the invention may be employed in several industrial applications wherein the heat fusing of filamentary textile materials may be enhanced by the employment of a wrapper and the heat fusing of the wrapper with the materials.

What is claimed is:

1. In a pile textile element for decorative pile articles comprising a bundle of a plurality of substantially parallel, heat-fusible filamentary textile materials and a removable wrapper encasing the bundle over at least a portion of its length, the improvement comprising:

(a) the wrapper comprised of heat-fusible material; and (b) the heat-fusible filamentary textile materials at one end of said bundle being fused together with the heat-fusible wrapper to form a flat base.

2. The pile textile element as claimed in claim 1 wherein said base has a thickness which is small compared to the length of the bundle, and a circumference which is generally the same configuration as and is slightly larger than the circumference of the wrapped bundle, said base projecting uniformly, in a plane substantially perpendicular to the longitudinal axis of the bundle, beyond the entire circumference of the wrapped bundle.

3. The pile textile element as claimed in claim 2 wherein the bundle comprises at least one void.

4. The pile textile element as claimed in claim 2 wherein said wrapper is a flexible envelope.

5. The pile textile element as claimed in claim 2 wherein said wrapper is a rigid envelope.

6. The pile textile element as claimed in claim 2 wherein the unfused portion of said wrapper is removable from the filamentary textile materials.

7. The pile textile element as claimed in claim 2 wherein said wrapper is fixed permanently to the filamentary textile materials.

8. The pile textile element as claimed in claim 2 and further comprising a supplementary base attached to said flat base.

9. The pile textile element as claimed in claim 8 wherein said supplementary base is flexible.

10. The pile textile element as claimed in claim 8 wherein said supplementary base is rigid.

11. The pile textile element as claimed in claim 8 wherein said supplementary base comprises a means for fixing the element for the purposes of decorative effect.

12. The pile textile element as claimed in claim 8 wherein said supplementary base is heat-sealable.

13. The pile textile element as claimed in claim 8 wherein said supplementary base contains magnetic elements.

14. The pile textile element as claimed in claim 8 wherein said supplementary base comprises a pointed extension which permits the affixing of said supplementary base.

15. The pile textile element as claimed in claim 8 wherein said base is self-adhesive.

16. The pile textile element as claimed in claim 2 wherein said wrapper is an envelope made from a film having a polyolefin base.

17. The pile textile element as claimed in claim 1 wherein said wrapper is comprised of a heat-fusible plastic.

18. The pile textile element as claimed in claim 17 wherein said plastic has a polyolefin base.

19. In a process for preparing a pile textile element for decorative pile articles wherein a bundle of a plurality of substantially parallel heat-fusible filamentary textile materials, which may be encased over a portion of, or its entire length, with a wrapper and the heat-fusible filamentary textile materials are fused together by application of heat at one end of the bundle, the improvement comprising the steps of:

(a) encasing a bundle of a plurality of substantially parallel heat-fusible filamentary textile materials over at least a portion of its entire length including at least one end thereof with a heat-fusible wrapper;

(b) placing the covered end of the bundle and a portion of the heat-fusible wrapper in contact with a heated surface at a temperature higher than the melting point of the heat-fusible filamentary textile materials, said surface being located in a plane which is perpendicular to a plane containing the longitudinal axis of the bundle;

(c) applying pressure between the heated surface, the heat-fusible wrapper and the end of the bundle in contact with the heated surface;

(d) allowing the heat-fusible filamentary textile materials and the heat-fusible wrapper to melt and uniformly flow over and slightly beyond the circumference of the wrapped bundle; and (e) removing the bundle from the heated surface whereby there is formed a flat base at one end of the bundle which projects uniformly beyond the circumference of the bundle.

20. The process of claim 19 wherein the pressure between the heated surface, the heat-fusible wrapper and the end of the bundle in contact with the heated surface falls between 10 and 600 g/cm$^2$.

21. The process of claim 20 wherein the heated surface is stainless steel at a temperature between 500° C. and 900° C.

22. The process of claim 21 wherein the step of allowing the heat-fusible filamentary textile materials and the heat-fusible wrapper to melt and uniformly flow over and slightly beyond the circumference of the wrapped bundle is limited to a period between 1/10 second and 5 seconds.

* * * * *